US006214079B1

(12) United States Patent
Kear et al.

(10) Patent No.: US 6,214,079 B1
(45) Date of Patent: Apr. 10, 2001

(54) TRIPHASIC COMPOSITE AND METHOD FOR MAKING SAME

(75) Inventors: Bernard H. Kear, Whitehouse Station; Rajendra K. Sadangi, Highland Park; Larry E. McCandlish; Oleg Voronov, both of Highland Park, all of NJ (US)

(73) Assignee: Rutgers, The State University, Piscataway, NJ (US)

( * ) Notice: Subject to any disclaimer, the term of this patent is extended or adjusted under 35 U.S.C. 154(b) by 0 days.

(21) Appl. No.: 09/468,651

(22) Filed: Dec. 21, 1999

Related U.S. Application Data

(62) Division of application No. 09/047,635, filed on Mar. 25, 1998.

(51) Int. Cl.[7] ..... C22C 29/00

(52) U.S. Cl. ..... 75/230; 75/239; 75/240; 75/241

(58) Field of Search ..... 75/230, 240, 239, 75/241

(56) References Cited

U.S. PATENT DOCUMENTS

| | | | | |
|---|---|---|---|---|
| 3,745,623 | | 7/1973 | Wentorf, Jr. et al. . | |
| 3,850,053 | | 11/1974 | Bovenkerk . | |
| 4,218,999 | | 8/1980 | Shearer . | |
| 4,231,762 | * | 11/1980 | Hara et al. | 51/309 |
| 4,259,090 | | 3/1981 | Bovenkerk . | |
| 4,260,397 | | 4/1981 | Bovenkerk . | |
| 4,525,178 | | 6/1985 | Hall . | |
| 4,604,106 | | 8/1986 | Hall et al. . | |
| 4,694,918 | | 9/1987 | Hall . | |
| 5,045,092 | | 9/1991 | Keshavan . | |
| 5,128,080 | | 7/1992 | Jurewicz et al. . | |
| 5,304,342 | | 4/1994 | Hall, Jr. et al. . | |
| 5,715,899 | | 2/1998 | Liang et al. . | |

FOREIGN PATENT DOCUMENTS 0 589 641 A2 3/1994 (EP) .

OTHER PUBLICATIONS

Mehan et al., "Thermal Degradation of Sintered Diamond Compacts", JNL of Mats. Science vol. 24 (1989), pp. 942–950.

Glowka, Use of Single–cutter Data in the Analysis of PCD Bit Designs: Part 1–Development of a PCV Cutting Force Model, JPT (Aug. 1989) pp. 797–849.

Sani, "Further Developments in PCD Tipped Drills" IDR 194, pp. 6–7.

Clark et al. "The Use of PCD for Petroleum and Mining Drilling", Ultrahard Materials Technical Conference, (1998) pp. 349–362.

Spur et al., Therm–mechanical Stress Cycle Tests on PCD Cutting Tool Materials Industrial Diamond Review (Jan., 1997) pp. 27–34.

(List continued on next page.)

*Primary Examiner*—Daniel J. Jenkins
(74) *Attorney, Agent, or Firm*—Paul A. Schwarz, Esq.; Buchanan Ingersoll, PC

(57) ABSTRACT

A method for fabricating a triphasic composite such as a WC/Co/diamond composite with a high volume fraction of diamond in a WC/Co matrix. The method involves sintering of a WC/Co powder compact to develop a porous preform, which displays some rigidity and strength, infiltrating the porous preform with a controlled distribution of carbon, and high pressure/high temperature treatment of the carbon-containing WC/Co preform to transform the carbon to diamond. The distribution of diamond in the composite can be functionally graded to provide a WC/Co core and a diamond-enriched surface, wherein all three phases form an interconnected structure in three dimensions. Such a tricontinuous structure combines high strength and toughness with superior wear resistance, making it attractive for applications in machine tools and drill bits.

11 Claims, 10 Drawing Sheets

OTHER PUBLICATIONS

Kear et al., Chemical Processing and Properties of Nanostructured WC–CO Materials, Nanostructured Materials vol. 3 (1993) pp. 19–30.

Voronov et al., "Nucleation of Diamond Crystals from the $SP^2$ and $SP^3$ Hydrocarbons Decomposed Under High Pressure" Diamond Materials V, Proc. vol. 97–32 of the Electrochemical Society (1997) pp. 197–200.

Voronov et al., "High Purity Diamond Layers Growing on the Diamond Substratum by Using the Hydrocarbon Decomposition Reactions Under High Pressure" Diamond Materials, V Proc. vol. 97–32 of the Electrochemical Society (1997) pp. 20–24.

Yakolev et al., The Equilibrium Constants of the Reactions for Obtaining Graphite and Diamond Using the Napthalene Resolution at High Pressure (P<5.0 Gpa, 300<T<1000 K), Diamond, Materials IV, Proc. vol. 95–4 of the Electrochemical Society (1995) pp. 100–105.

Yakolev, et al., "The Hydrogen Concentration for the Graphite and Diamond Growth $CH_4$ as Species, $P=1*10^3$ $5*10^3$Mpa, T=500–1000 K." Diamond Material Proceedings III, vol. 93–17 of the Electrochemical Society, (1993) pp. 9–16.

Voronov et al. "Diamond compacts", Diamond Material Proceedings III, vol. 93–17, pp. 1018–1024.

Vereshchagin et al., Comparative Drilling Tests of ASPK-Tipped and Hard–Faced Drill Bits, L. Vereshchagin "Synthetic Diamonds and Hydrostatic Extrusion Selected Papers" General Editorial Board for Foreign Language Publications, Moscow, USSR, 1987) pp. 182–186.

Vereshchagin et al., Synthesis of Ballas–Type Diamond DAN SSSR, (1967) 172, p. 76 in L. Vereshchagin "Synthetic Diamonds, and Hydrostatic Extrusion Selected Papers" General Editorial Board for Foreign Language Publications, Moscow. USSR, 1987) pp. 73–74.

Yakovlev et al., "Synthesis of Carbonado–Type Diamonds" DAN SSSR, (1969), 185, p. 555 L. Vereshchagin "Synthetic Diamonds and Hydrostatic Extrusion Selected Papers" General Editorial Board for Foreign Language Publications, Moscow. USSR, 1987) pp. 75–77.

Vereschagin et al., "Microcrystalline Diamond Material and Methods for Growing It Into Bodies With Predetermined Shape" L. Vereshchagin "Synthetic Diamonds and Hydrostatic Extrustion Selected Papers" General Editorial Board for Foreign Language Publications, Moscow, USSR, 1987) pp. 83–86.

Vereschagin et al., "Thermal Stability of Polycrystalline Diamond and Borazon Sintered to Metal–Ceramics Binders at Pressures up to 50 kbar", L. Vereshchagin "Synthetic Diamonds and Hydrostatic Extrusion Selected Papers" General Editorial Board for Foreign Language Publications, Moscow, USSR, 1987) pp. 118–121.

Dovbnya et al., "Application of ACIIK–Diamond Drill Bits for Borehole Surveying" L. Vereshchagin "Synthetic Diamonds and Hydrostatic Extrusion Selected Papers" General Editorial Board for Foreign Language Publications, Moscow. USSR, 1987) pp. 177–180.

Dovbnya et al., Sinking Prospecting Holes in Hard Rocks with ACIIK–Tipped Drill Bits, L. Vereshchagin "Synthetic Diamonds and Hydrostatic Extrusion Selected Papers" General Editorial Board for Foreign Language Publications, Moscow. USSR, 1987) pp. 181–182.

Dovbnya et al., Manufacturing Polycrystalline–Tipped Cutting Tool Inserts by Powder Metallurg, Diamonds, Issue 2, Moscow, NMMASh, 1972, pp. 171–173.

* cited by examiner

TRIPHASIC COMPOSITE AND METHOD FOR MAKING SAME

RELATED APPLICATIONS

This application is a division of commonly assigned, co-pending application Ser. No. 09/047,635 entitled TRIPHASIC COMPOSITE AND METHOD FOR MAKING SAME, filed Mar. 25, 1998.

FIELD OF THE INVENTION

This invention relates to triphasic composites useful in abrasive wear and impact resistant applications and methods for making same. More particularly, this invention relates to a tungsten carbide/cobalt/diamond composite fabricated by infiltrating a porous tungsten carbide/cobalt preform with a controlled quantity of carbon and converting the carbon disposed within the preform to diamond using hot-pressing.

BACKGROUND OF THE INVENTION

Polycrystalline diamond has greater impact resistance than single crystal diamond. This is because polycrystalline diamond is made up of randomly oriented grains which do not provide paths for cleavage crack propagation. In contrast, a single cleavage crack can rapidly propagate across a single crystal diamond. For these reasons, polycrystalline diamond is favored over single crystal diamond in many commercial applications.

Unfortunately, the impact resistance of polycrystalline diamond is still relatively low. This is due to diamond's high elastic modulus. This is a problem in some applications because polycrystalline diamond wears by micro-fracture and spalling, and not by atomic shearing.

The relative brittleness of polycrystalline diamond has been addressed in the prior art. The first commercially available polycrystalline diamond products were composite compacts comprised of a metallic backing layer bonded directly to a diamond layer, as shown in U.S. Pat. No. 3,745,623. The most common form of this composite compact comprised a planar disc of polycrystalline diamond grown directly onto a pre-cemented disc of tungsten carbide/cobalt (WC/Co) during hot pressing.

Substrate-supported polycrystalline diamond composites possess a number of limitations. First, polycrystalline diamond tool designs are limited by substrate-supported polycrystalline diamond configurations. There are many conceivable uses for polycrystalline diamond tools that are difficult or impossible to implement with a substrate-supported polycrystalline diamond composite. These uses include rotary tools like miniature grinding wheels and drills which are constructed symmetrically about a line and have working faces that are subjected to tangential forces. Although some work has been done to adapt substrate-supported polycrystalline diamond composites to such uses (see for example U.S. Pat. No. 4,218,999 which describes a rotary tool comprised of a cylinder of polycrystalline diamond grown around a core of pre-cemented carbide), rotary tools are generally not commercially possible to implement with substrate-supported polycrystalline diamond.

Second, the pre-cemented carbide substrate of a substrate-supported polycrystalline diamond composite has a higher coefficient of thermal expansion than the polycrystalline diamond of the composite. Because the bond between the diamond layer and the carbide substrate is formed when both materials are at a temperature ranging between 1500° C. and 2000° C., high stresses are created when the composite compact cools to ambient temperature.

Third, the diamond layer thickness in a substrate-supported polycrystalline diamond composite is limited by "bridging" of the fine diamond powder used in making the polycrystalline diamond. Bridging is a phenomenon which occurs when fine powders are pressed from multiple directions. During pressing the individual particles in the pressed fine powder tend to stack up and form arches or bridges which prevent the full pressing pressure from reaching the center of the powder compact. When 1 micron diamond powder is used to make a polycrystalline diamond body having a thickness greater than about 0.06 inches, the diamond towards the center of the piece is typically not compacted as densely as the exterior portions of the piece. This pressing density gradient can result in cracking and chipping of the polycrystalline diamond layer.

Other polycrystalline diamond composites have been described for use as wear resistant cutting elements. U.S. Pat. No. 3,850,053 discloses a method for making a cutting tool blank by placing a graphite disc in contact with cemented WC/Co and simultaneously exposing them both to diamond forming temperatures and pressures. U.S. Pat. No. 4,525,178 discloses a composite material that includes a mixture of individual diamond crystals and pieces of pre-sintered cemented carbide. The mixture is heated and pressurized to create intercrystalline bonds between diamond crystals, and chemical bonds between diamond crystals and pre-sintered cemented carbide pieces. U.S. Pat. No. 5,128,080 describes a method for making a diamond-impregnated carbide. The method comprises liquid phase sintering a green body fabricated from a WC/Co/graphite powder blend and transforming the graphite in the sintered mass to diamond using hot-pressing (high pressure/high temperature). The particle size of each of the phases in the consolidated product was in the range 0.3–100 microns. It was not possible, however, to make a composite having phases which each have a grain size less than 0.2 microns. The relatively large size of the resulting diamond particles can result in an easy crack propagation path in the composite. Moreover, volume fractions of diamond greater than 25 volume percent could not be incorporated into the blend because the carbon segregated from the WC and Co due to large differences in their densities.

Thermal expansion mismatch stresses exist between the diamond facing and the supporting WC/Co substrate in prior art composites. Such stresses can adversely affect the bonding of the diamond to the substrate, leading to spalling under typical service conditions.

Recent developments in the synthesis and consolidation of submicron-grained WC/Co powder has resulted in higher hardness and compressive strength in the fully sintered material. Utilizing such a material to produce a WC/Co/diamond composite opens new opportunities to design and manufacture a new generation of superhard tool materials.

Accordingly, there is a need for an improved triphasic composite and method for making same that substantially overcomes the problems and disadvantages of the prior art.

SUMMARY OF THE INVENTION

A tricontinuous composite comprising a superhard phase material; a hard phase material; and a binder phase material. The three material phases of the composite are interconnected in three dimensions and the superhard phase material forms approximately 10–100 volume percent of the composite's exterior surface. The tricontinuous composite is fabricated in a method which comprises providing a hard phase material and a binder phase material as a porous preform of an article. Next, the porous preform is infiltrated with a predetermined quantity of at least one precursor of a superhard phase material. The precursor is then transformed to the superhard phase material.

BRIEF DESCRIPTION OF THE DRAWINGS

The advantages, nature and various additional features of the invention will appear more fully upon consideration of the illustrative embodiments described in detail below, considered together with the accompanying drawings. In the drawings.

It should be understood that the drawings are for purposes of illustrating the concepts of the invention and are not to scale.

DETAILED DESCRIPTION OF THE INVENTION

A method for making a triphasic composite is described herein. The triphasic composite comprises three polycrystalline material phases which are interconnected in three dimensions, thus, forming a "tricontinuous" structure. The three polycrystalline material phases include a superhard phase material, a hard phase material, and a binder phase material. The superhard phase material may include diamond, cubic boron nitride BN), boron carbonitride, mixtures of diamond and cubic BN, mixtures of diamond and boron carbonitride, or other superhard phase materials. The hard phase material may include tungsten carbide (WC), silicon carbide (SiC), boron carbide ($B_4C$), chronium carbide ($Cr_3C_2$), vanadium carbide (VC), tantulum carbide (TaC), niobium carbide (NbC), hafnium carbide (HfC), mixtures thereof, or other hard phase materials. The binder phase material may include cobalt (Co), nickel (Ni), chromium (Cr), iron (Fe), manganese (Mn), or mixtures thereof. The superhard phase material may form approximately 10–100 volume percent of the exterior surface of the composite.

Figure 1:
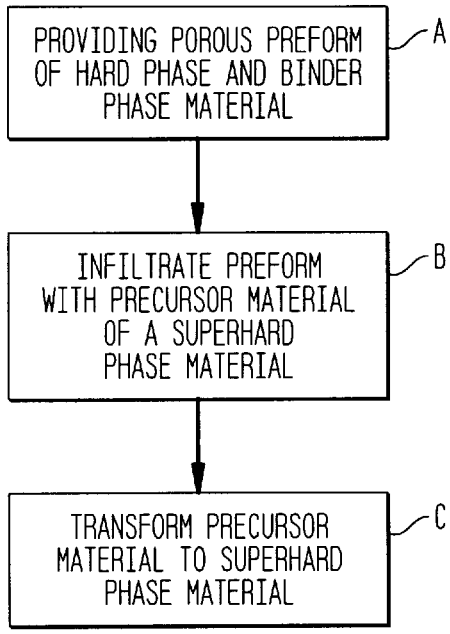
FIG. 1 is a block diagram depicting the steps of the method of the present invention.

Referring to FIG. 1, block A of the method consists of providing a porous preform. The preform may have a shape of a desired article. The porous preform is composed of at least one of the earlier described hard phase materials and at least one of the earlier described binder phase materials. The porous preform is produced by partially sintering a powder compact (produced by conventional pressing or extrusion methods) composed of the selected hard and binder phase materials. When partially sintered, the hard phase and binder phase particles form a bicontinuous structure that displays some rigidity and strength. At this stage of the method, additional precision shaping of the preform may be carried out because the porous material is easily machined.

In block B of the method, the porous preform is infiltrated with a predetermined quantity of one or more precursor materials of the earlier described superhard phase materials. Examples of these precursor materials include carbon (precursor material for diamond) and boron nitride (precursor material for cubic BN). Infiltration may be accomplished using impregnation of solid precursors, infiltration of liquid precursors or infiltration using chemical vapor precursors. Infiltration enables different types of low density materials or reactive compounds to be distributed within the porous preform. The size, shape and distribution of the infiltrated material can be controlled by increasing or decreasing the quantity of the precursor material, or by increasing or decreasing the length of time of infiltration. Accordingly, a gradient distribution of the precursor material can be provided through the porous preform such that the amount of the precursor material increases gradually from the interior or core of the preform to the exterior of the preform. The precursor material can also be provided in a uniform distribution throughout the preform.

In block C of the method, the precursor material is disposed within the porous preform is transformed to the superhard phase material. Accordingly, a tricontinuous fully sintered composite having three, three-dimensionally interconnected polycrystalline material phases is realized. The polycrystalline material phases of the composite will include a superhard phase material, a hard phase material, and a binder phase material. The distribution of the superhard phase material in the fully sintered composite will increase gradually from the interior or core of the composite to the exterior of the composite if the precursor material was gradiently distributed through the porous preform. The superhard phase material introduced into the surface of the composite can range from about 10 to 75 volume percent. The distribution of the superhard phase material in the fully sintered composite will be uniform from the interior to the exterior of the composite if the precursor material was uniformly distributed through the porous preform.

Transformation of the precursor material to the superhard phase material may be accomplished using a high pressure/high temperature (HPHT) process. In the HPHT process, the precursor infiltrated porous preform is introduced into a resistively-heated high pressure cell and subjected to a pressure of about 5–15 GPa at a temperature of about 1000–2000° C.

The method of the invention is especially useful for producing a functionally graded, tricontinuous nanophasic WC/Co/diamond composite. The WC/Co/diamond composite comprises a WC/Co core and a diamond-enriched surface. All three phases of the composite each have a grain size less than 0.1 micron (less than 100 nanometers) and form an interconnected structure in three dimensions. The WC/Co/diamond composite combines high strength and toughness with superior wear resistance, making it attractive for applications in machine tools and drill bits.

The WC/Co/diamond composite is made in the above described method by partially sintering a WC/Co powder compact preferably pressed from a submicron or "nanophase" WC/Co starting powder. Partial sintering may be performed at a temperature approximately ranging between 800° C. and 1450° C, and preferably between 800° C. and 1150° C. The nanophase WC/Co powder can be obtained from Nanodyne Corporation.

The nanophase WC/Co powder is produced in a well known spray conversion process (SCP). The SCP process involves preparing an aqueous solution of mixed tungsten and cobalt salts which provides a starting solution of a fixed composition. The solution is then spray dried to form an amorphous precursor powder consisting of a uniform mixture of salts. The precursor powder is converted into the nanophase WC/Co product powder using a fluid-bed thermochemical conversion process which involves pyrolysis, reduction and carburization of W to WC. During the carburization of W to WC, a controlled carbon activity gas stream of $CO/CO_2$ or $CO/H_2$ is used to fully carburize W without producing excess graphitic carbon. The nanophase WC/Co powder has a spherical-shell morphology similar to that of a spray-dried powder (typically 5–50 microns in diameter and 2–10 micron wall thickness). However, unlike a typical spray-dried powder, the nanophase WC/Co powder product has a high degree of interconnected porosity. This provides the WC/Co powder particles with a sponge-like structure, with the walls of the sponge composed of equiaxed grains of well-bonded WC and Co nanoparticles.

The partially sintered porous WC/Co preform obtained from the nanophase WC/Co powder compact is infiltrated with a carbon precursor material. Infiltration of the porous WC/Co preform is preferably accomplished by chemical vapor infiltration of amorphous or graphitic carbon supplied at low pressure using gaseous hydrocarbons, such as methane, ethane, or ethylene. Infiltration may also be achieved by liquid phase infiltration at high pressure using liquid hydrocarbons, such as wax, pitch, and bitumen, or by impregnation with carbon at high pressure using fullerenes. During infiltration, the deposition of carbon can be controlled to give a specific volume fraction of carbon relative to that of the original WC and Co phases thereby providing a uniform or functional distribution of carbon in the porous preform.

The carbon-infiltrated WC/Co preform is introduced into the resistively-heated high pressure cell and subjected to the 5–15 GPa pressure and 1000–2000° C. temperature (the HPHP process). Under these conditions, the cobalt promotes the transformation of carbon to diamond inside the WC/Co. Accordingly, the highly desirable tricontinuous nanophasic WC/Co/diamond composite is realized. The resulting WC/Co/diamond composite comprises a diamond polycrystal which grows through the nanostructured WC/Co polycrystal. The diamond polycrystal rises inside the WC/Co polycrystal and grows from the bottom to the top of the composite.

Figure 2A:
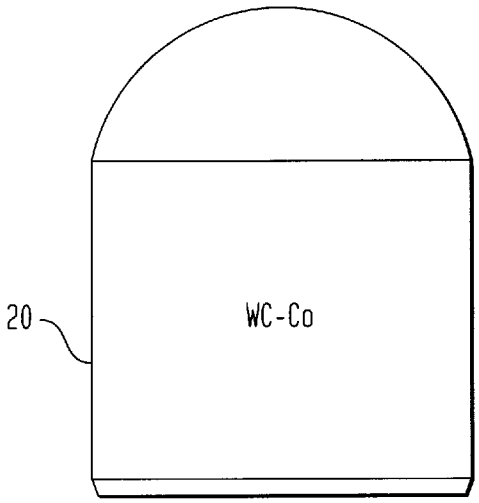
FIG. 2A (PRIOR ART)
FIGS. 2A–2B are schematic representations of conventional stud inserts for roller cone drill bits.
Figure 2B:
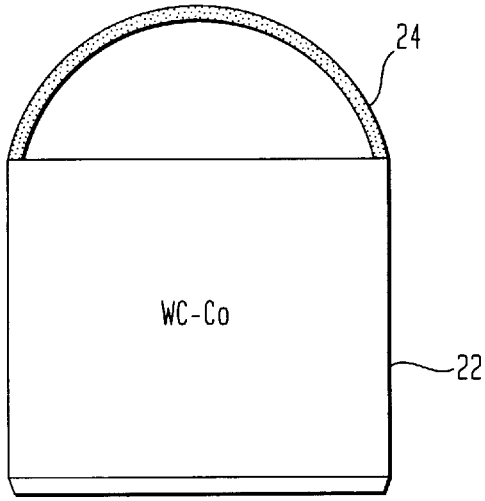
FIG. 2B (PRIOR ART)
Figure 2C:
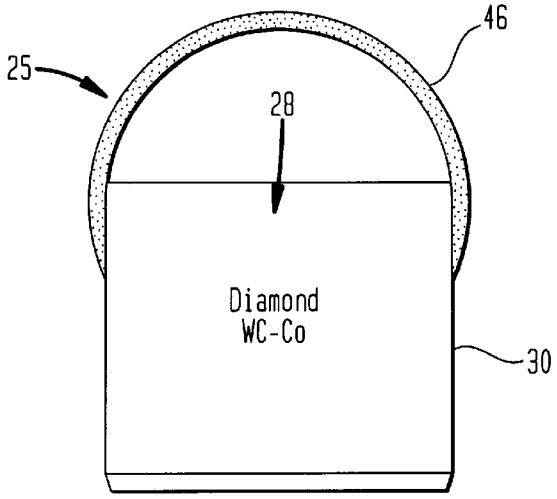
FIG. 2C is a schematic representation of a stud insert for a roller cone drill bit made according to the present invention.

FIGS. 2A–2C are schematic representations of "stud inserts" for roller cone drill bits. FIG. 2A shows a conventional WC/Co insert 20 and FIG. 2B shows a conventional WC/Co insert 22 with a polycrystalline diamond layer 24. FIG. 2C shows a functionally graded WC/Co/diamond insert 26 made according to the method of the present invention. The graded insert 26 has a core 28 which contains less than 5 volume percent diamond phase material. The volume percent of the diamond phase material gradually increases to greater than 50 volume percent diamond phase material as you move from the core 28 to the exterior 30 of the graded insert 26. The insert 26 is also coated with an optional layer of polycrystalline diamond 46. This provides about 100 volume percentage of diamond at the surface of the insert 26. Because the insert 26 is functionally graded, thermal expansion and modulus mismatching stresses are avoided at the interface of the diamond layer 46 and the insert 26. Consequently, as the diamond layer 46 wears away in service (usually at an inclined angle), the presence of the graded underlying insert surface reduces the wear rate and increases the useful life of the insert 26.

The optional diamond layer 46 may be fabricated by applying a layer of diamond grit to the carbon infiltrated insert preform prior to the transformation step. The preform is then subjected to HTHP carbon transformation process which bonds the diamond grit layer (which is transformed to the polycrystalline diamond layer 46) to the insert and transforms the infiltrated carbon to polycrystalline diamond.

The diamond layer may also be fabricated by applying a layer of catalyzed carbon to the carbon infiltrated insert preform prior to the transformation step. The preform is then subjected to HTHP carbon transformation process which transforms the infiltrated carbon and the carbon layer to polycrystalline diamond.

Figure 3A:
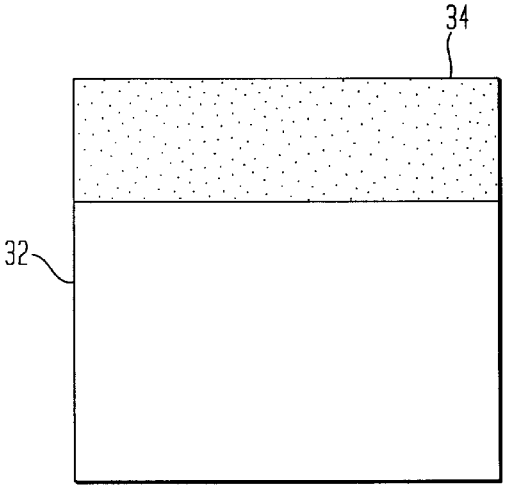
FIG. 3A (PRIOR ART)
FIG. 3A is a schematic representation of a conventional insert for a drag drill bit.
Figure 3B:
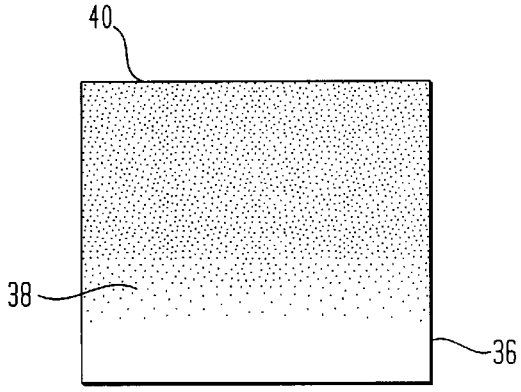
FIG. 3B is a schematic representation of an insert for a drag drill bit made according to the present invention.

FIGS. 3A and 3B are schematic representations of polydiamond carbide inserts for drag drill bits. FIG. 3A shows a conventional WC/Co insert 32 with a polycrystalline diamond layer 34. FIG. 3B shows a functionally graded WC/Co/diamond insert 36 made according to the method of the present invention. The graded insert 36 has a core 38 which contains less than 5 volume percent diamond phase material. The volume percent of the diamond phase material gradually increases to about 80 volume percent diamond phase material as you move from the core 38 to the exterior 40 of the graded insert 36.

The following discussion sets forth the applicants' experimental work. Porous preforms were fabricated from three different types of starting nanophase WC/Co powders. These powders consisted of as-synthesized powder, mechanically milled as-synthesized powder, and solid agglomerated, mechanically milled as-synthesized powder.

As-synthesized nanophase WC/Co powders, produced by Nanodyne Inc., are typically about 5–50 microns in diameter and have a characteristic spherical-shell morphology. The thick walls of these hollow particles are highly porous in nature and are composed of equiaxed nanograins of WC and Co phases.

Porous WC/Co preforms were produced from as-synthesized WC/Co powder by first separating the shell-like particles using sieving and other known methods. Particles of the same diameter were then poured into a mold, lightly compressed, and sintered at 850–1150° C. in a reducing environment. In this temperature range, surface diffusion dominates so that sintered junctions are formed between the particles without a significant reduction in the size of the compact. Consequently, the powder compact retains its initial porosity, albeit in a somewhat coarsened form.

Figure 4A:
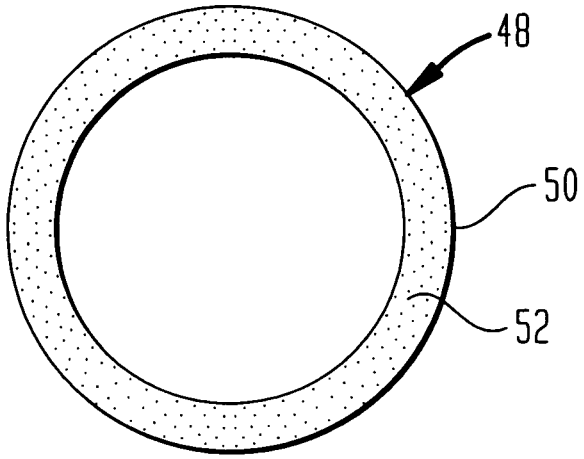
FIG. 4 shows a porous WC/Co preform produced from as-synthesized nanophase WC/Co powder.

FIG. 4A schematically shows a single spherical shell particle 48 of as-synthesized nanophase WC/Co powder. The particle 48 typically measures about 10–15 microns in diameter. The wall 50 or shell of the particle 48 is connected together by smaller pores 52.

Figure 4B:
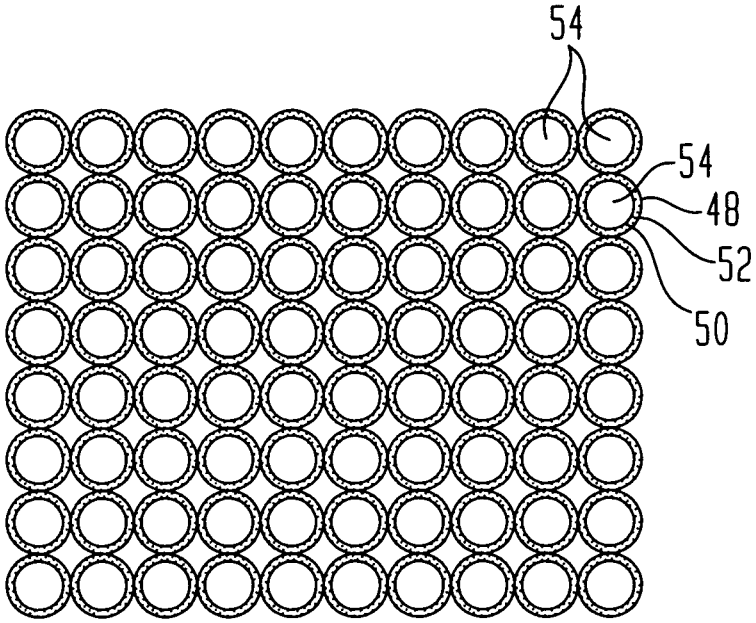

FIG. 4B schematically shows a section of one of the porous WC/Co preforms produced from as-synthesized nanophase WC/Co powder. The preform was highly porous and consisted of large pores 54 define by the shell-like particles 48, connected together by much smaller pores 52 (within the walls 50 of the shell-like particles 48). A similar but more irregular sintered structure was developed when the powder compact was heavily compressed to break up many of the shell-like particles in the mold, prior to partial sintering.

It should be noted that the preferred sintering temperature will depend on whether or not the nanophase WC/Co powder contains additives, such as VC or $Cr_3C_2$, which are known grain growth inhibitors. Since these additives reduce the incipient melting point of the Co-rich matrix phase, partial sintering may be achieved at temperatures ~850° C.

Figure 5:
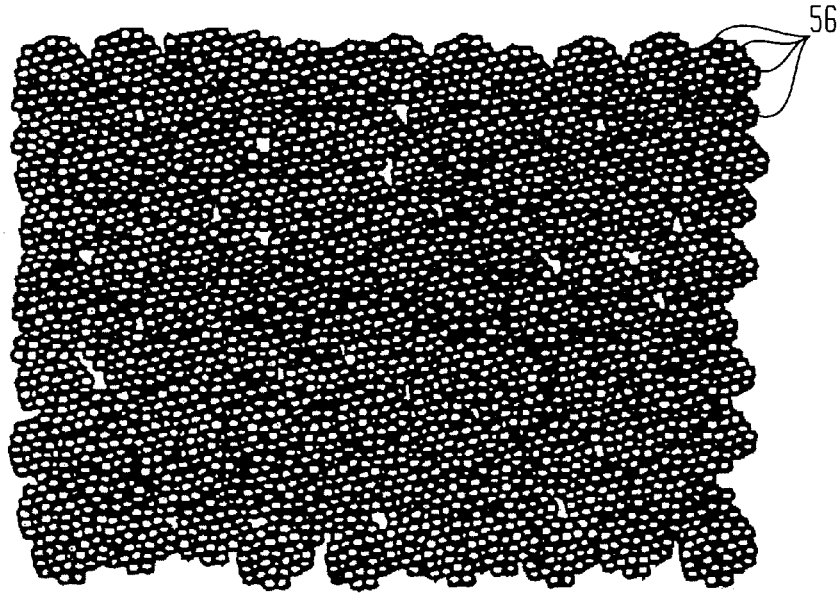
FIG. 5 shows as-synthesized nanophase WC/Co powder after about ½ hour of milling.

Porous WC/Co preforms were produced from mechanically milled as-synthesized nanophase WC/Co powder. Mechanical milling easily breaks up the as-synthesized WC/Co powder into finer size fractions. The operation was carried out in an oxygen-free environment to avoid powder contamination. This was achieved by mechanically milling the WC/Co powder in a fluid medium of hexane plus 10% paraffin binder under a blanket of argon. After about ½ hour of milling, the shell-like nanocomposite particles 48 were reduced to fragments 56 that were about 0.1–0.3 microns in diameter as shown in FIG. 5.

The powder fragments were cold pressed at 0.5–1.0 GPa, and then partially sintered at 850–1050° C. in flowing 2% $H_2$/argon mixture to produce a porous WC/Co preform. The resulting oxygen-free porous preform had a uniform interconnected network of fine submicron-scale pores. To avoid further contamination, the powder was passivated with a hydrocarbon species, such as hexane/10% paraffin mixture.

Figure 6:
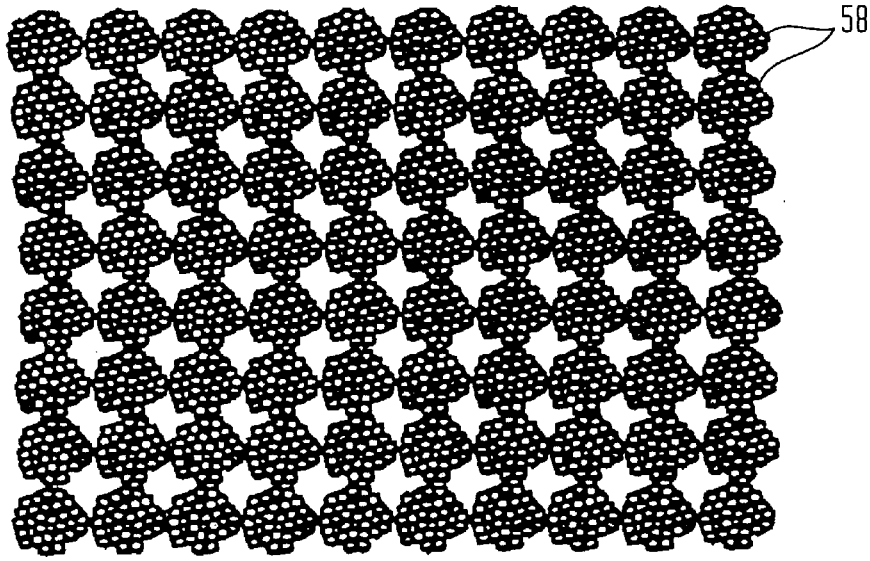
FIG. 6 shows re-agglomerated, mechanically milled as-synthesized nanophase WC/Co powder.

Porous WC/Co preforms were produced from solid agglomerated, mechanically milled as-synthesized nanophase WC/Co powder. Mechanically milled powder, reduced to fragments 56 about 0.1–0.3 micron size, as described above, can be re-agglomerated by spray drying using a suitable binder phase, preferably a water-soluble binder, such as polyvinyl alcohol. By making appropriate adjustments in the spray drying parameters, which are well known to those skilled in the art, re-agglomerated powder can be produced to provide particles 58 with a size controllable over the 5–50 micron size range as shown in FIG. 6.

Porous WC/Co preforms were formed by pouring the agglomerated powder into a mold, lightly compressing the powder, and partially sintering the powder at 850–1050° C. in a 2% $H_2$/argon atmosphere.

Examples of fully sintered composites composed from nanophase WC/8 wt. % Co and nanophase WC/15 wt. % Co are now described. Partially sintered preforms of nanophase WC/15 wt. % Co exhibited higher strengths than partially sintered preforms of nanophase WC/8 wt. % Co. Although both types of material have their uses, WC/15 wt. % Co has greater applicability because of its higher intrinsic fracture resistance.

EXAMPLE 1

Nanophase WC/15 wt. % Co powder was uniaxially compacted at 50 MPa into a 3 mm diameter×2 mm high sample. A floating die configuration was used to minimize density gradients in the green body. The compact was placed in a graphite crucible and inductively heated to 800° C. in flowing $H_2$ to remove surface oxides. Subsequently, the chamber was evacuated and the sample heated to 900° C for 30 minutes. No significant dimensional changes occurred during this pre-sintering treatment. The pre-sintered compact was 36% dense and had sufficient strength for handling purposes.

Figure 7:
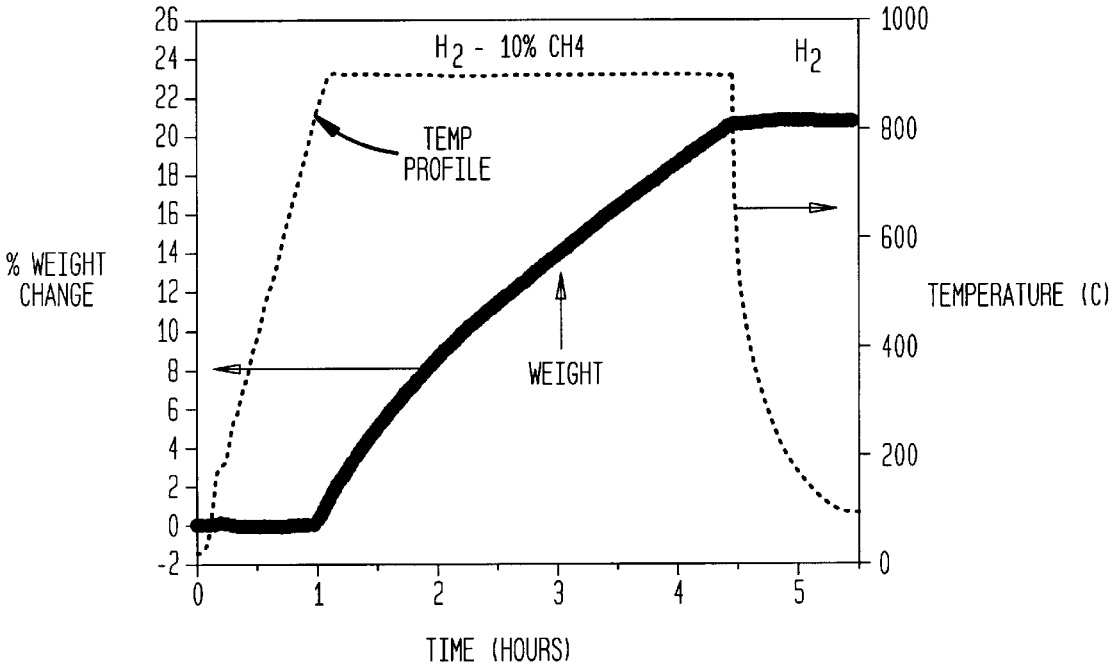
FIG. 7 shows a TGA trace of an infiltrated WC/15 wt. % Co preform.

Chemical vapor infiltration (CVI) of the porous compact was carried out in a controlled atmosphere thermal gravimetric analyzer (TGA). Weight changes were recorded using a Cahn 1000 micro-balance. The temperature of the furnace was ramped at 15° C./min. up to 900° C. in a flowing gas mixture (100 cc/min.) of $H_2$/10% $CH_4$, and held at this peak temperature for 3 hours. FIG. 7 shows a TGA trace indicating carbon pick up by chemical vapor infiltration of a WC/15 wt. % Co preform. The corresponding weight pick up of the sample was about 20 wt. %, which is equivalent to about 45 vol. % carbon deposited within the porous sample.

Figure 8A:
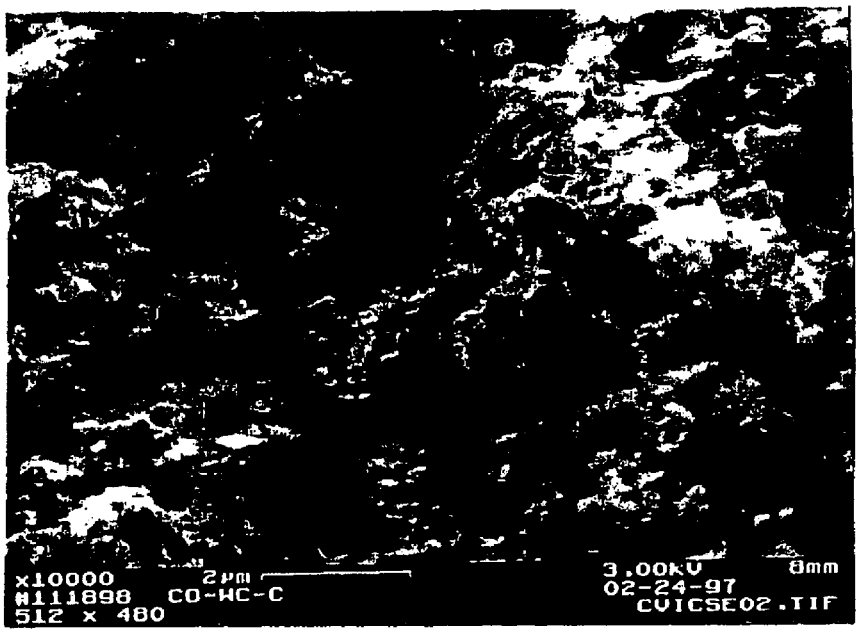
FIGS. 8A and 8B are scanning electron micrographs of a triphasic composite made according to the method of the present invention.
Figure 8B:
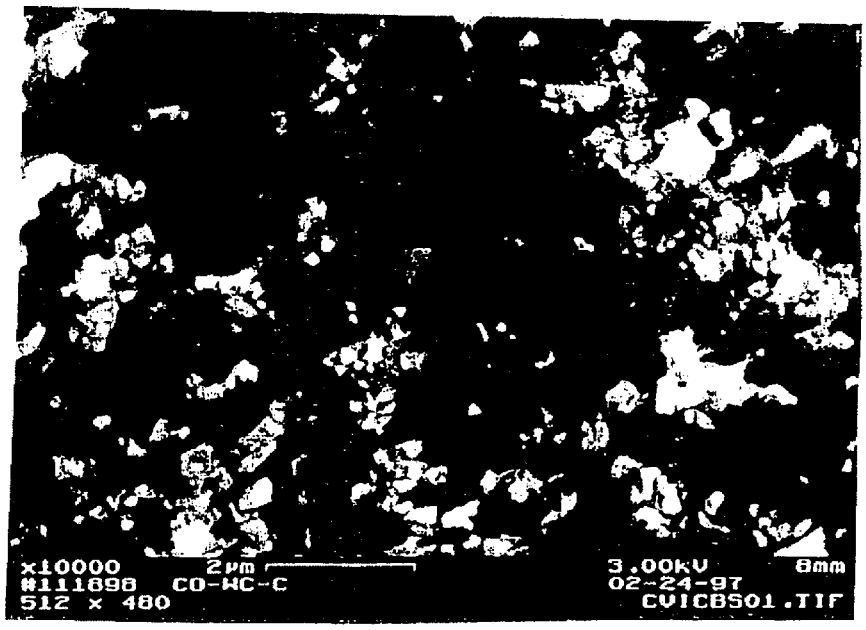

The carbon-infiltrated sample was then placed in the reaction cell of a high pressure/high temperature (HPHT) press. The space between the sample and graphite crucible was packed with hexagonal BN, which acts as an insulator and pressure transmitting medium. The porous sample was heated to ~1600° C. under a pressure of 8 GPa in order to fully consolidate the material, and to transform the graphite to diamond. The formation of a relatively high volume fraction of diamond was established by scanning electron microscopy (SEM) examination. FIG. 8A is a secondary electron image, scanning electron micrograph showing bright areas that represent mixtures of WC and Co, and much darker areas that represent diamond. FIG. 8B is a back-scattered electron image, scanning electron micrograph which confirms this WC/Co/diamond phase distribution.

Figure 9A:
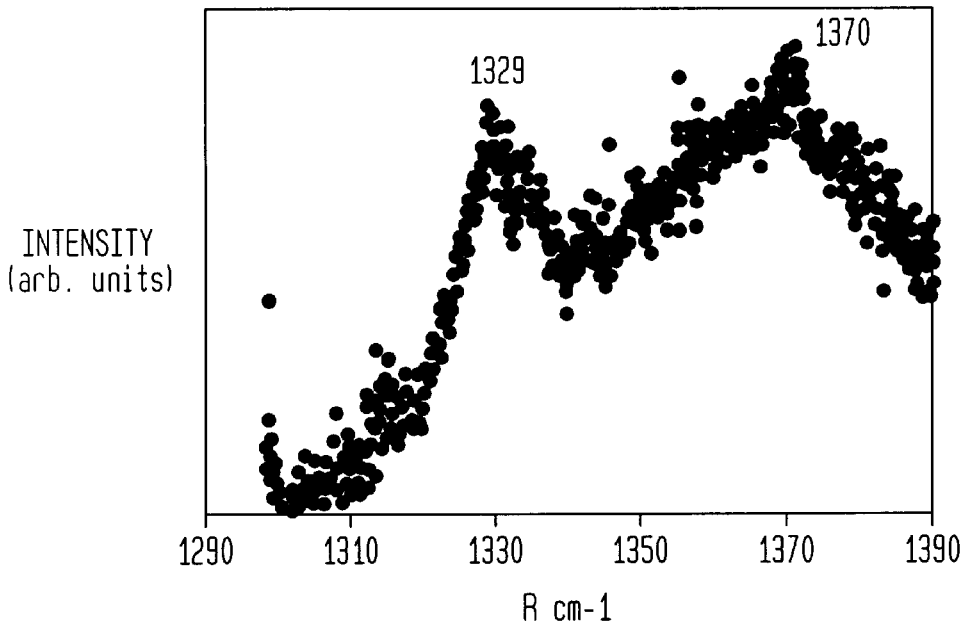
FIGS. 9A and 9B are Raman spectra of a triphasic composite made according to the method of the present invention.
Figure 9B:
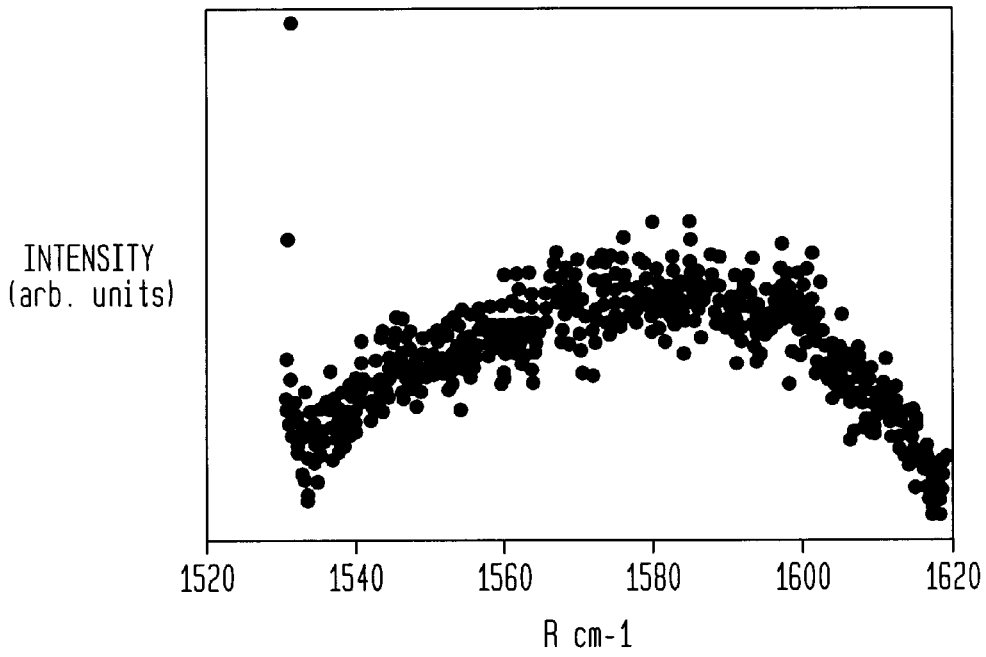

The formation of a relatively high volume fraction of diamond was also confirmed by Raman examination. Raman microprobe spectra were recorded from 1290–1390 $cm^{-1}$ and from 1520–1620 $cm^{-1}$ $^{at}$ 0.1 $cm^{-1}$ intervals. FIG. 9A is the spectra collected at 1290–1390 $cm^{-1}$. The spectra showed two peaks, one at 1329 $cm^{-1}$ and the other at 1370 $cm^{31\ 1}$. The first peak corresponds to diamond and the second peak corresponds to disordered diamond. FIG. 9B is the spectra collected at 1520–1620 $cm^{-1}$ . The absence of a peak at 1580 $cm^{-1}$ clearly shows that there is no graphitic carbon in the sample. The Raman spectra is similar in appearance to that found in a CVD-generated microcrystalline diamond film.

EXAMPLE 2

Figure 10:
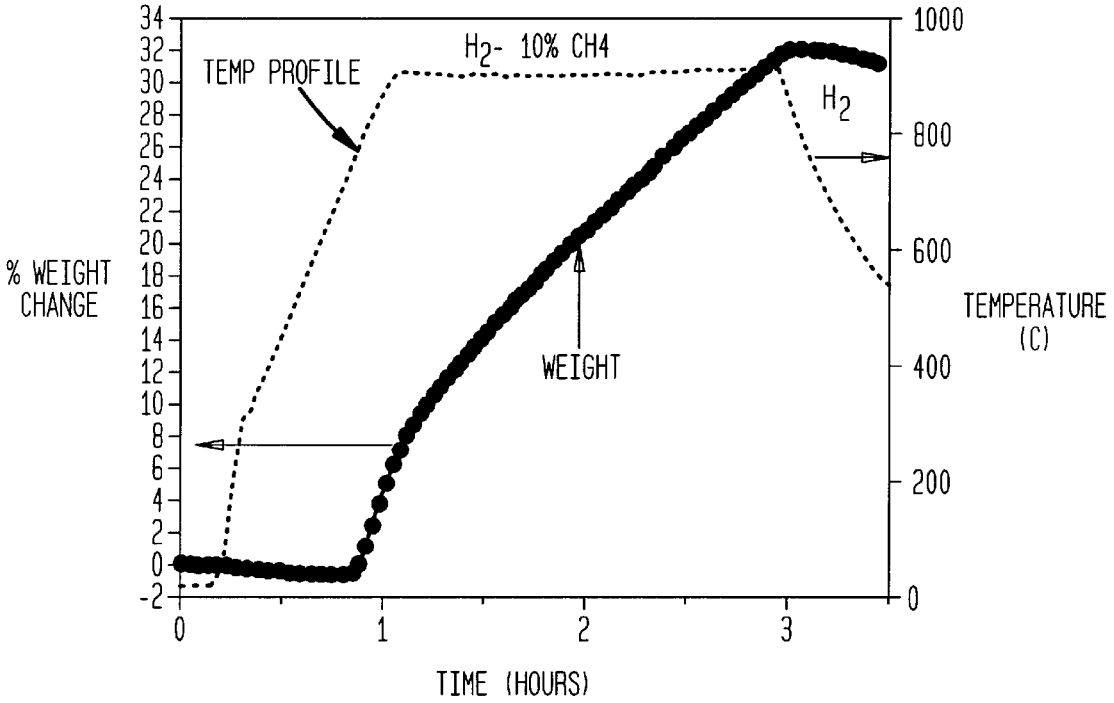
FIG. 10 shows a TGA trace of infiltrated WC/15 wt. % Co powder.

Nanophase WC/15 wt. % Co powder was placed in a platinum boat, and chemical vapor infiltration (CVI) of the loose powder mass was carried out in a controlled atmosphere TGA unit. Weight changes were recorded using a Cahn 1000 microbalance. The temperature of the furnace was ramped at 15° C./min. up to 900° C. in a flowing gas mixture (100 cc/min.) of $H_2$/10% $CH_4$, and held at this peak temperature for 3 hours. FIG. 10 shows a TGA trace indicating carbon pick up by chemical vapor infiltration of WC/15 wt. % Co powder. The weight pick up experienced by the sample was about 30 wt. %, which is equivalent to about 55 vol. % of carbon deposited within the porous powder mass.

Figure 11A:
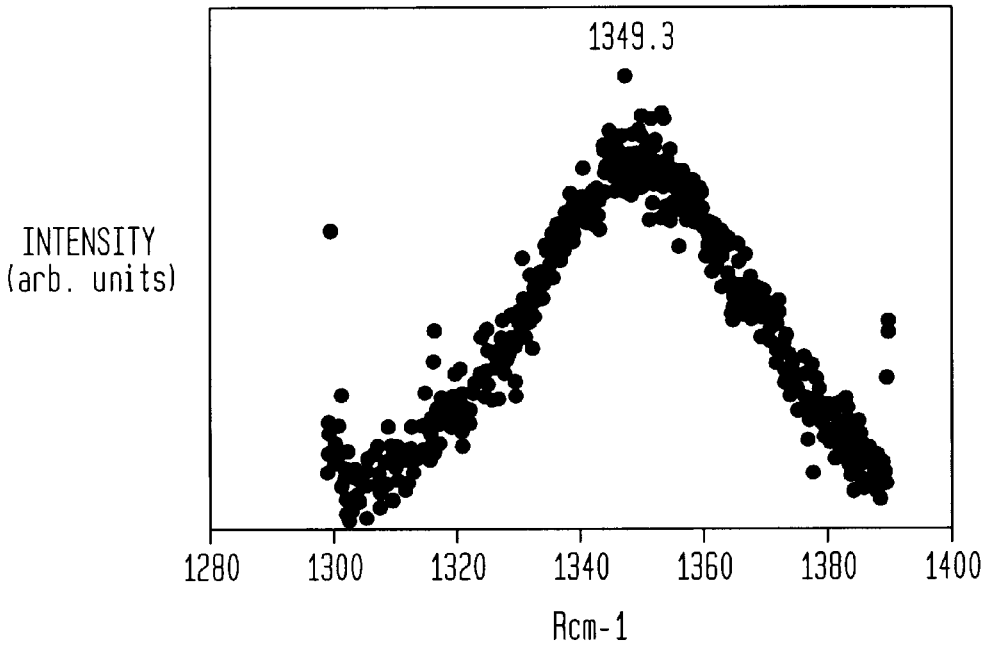
FIGS. 11A and 11B are Raman spectra of a triphasic composite powder made according to the method of the present invention.
Figure 11B:
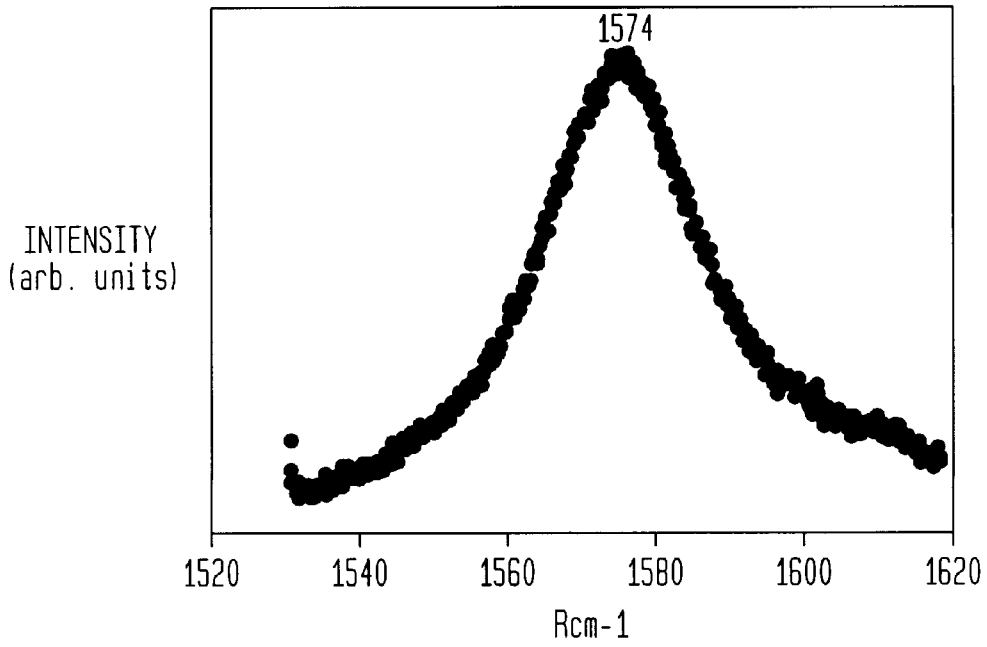
Figure 12A:
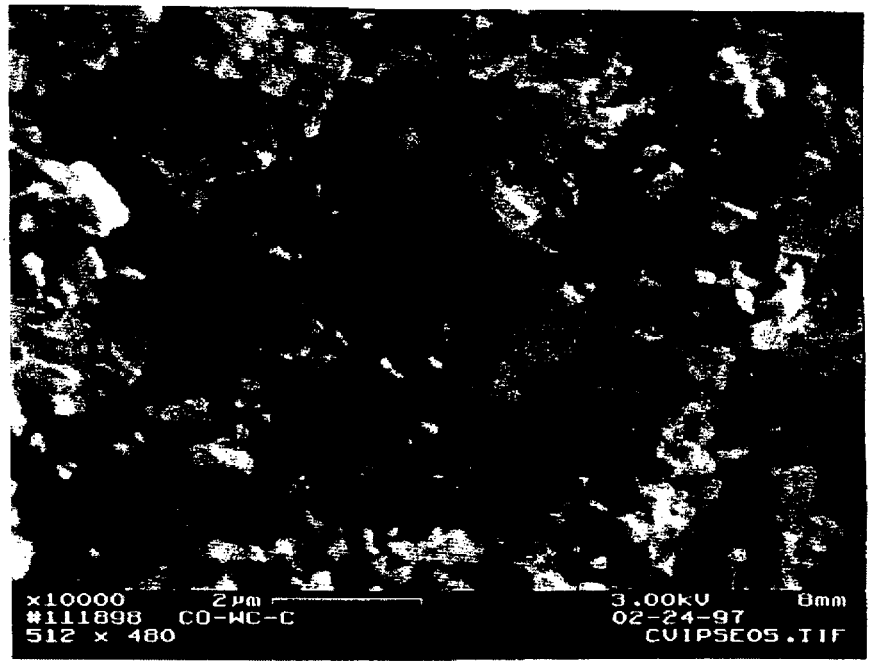
FIGS. 12A and 12B are scanning electron micrographs of a triphasic composite powder made according to the method of the present invention.
Figure 12B:
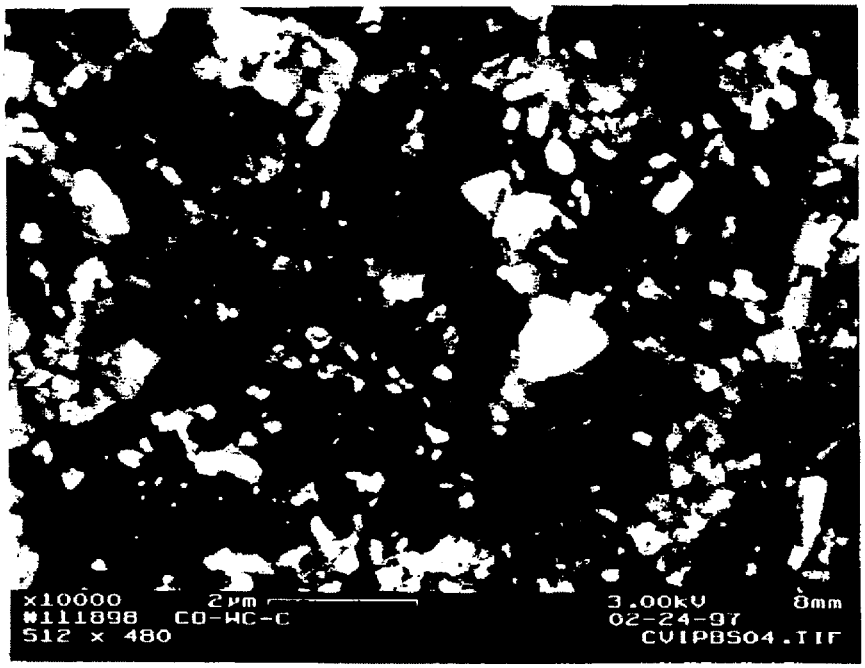

The carbon-infiltrated sample was placed in the reaction cell of an HPHT unit. The porous powder mass was heated to ~1600° C. under a pressure of 8 GPa in order to fully consolidate the material, and to transform the graphite to diamond. Raman and SEM examination confirmed the presence of a high volume fraction of diamond. FIG. 11 A is a Raman spectra of the HPHT treated sample in the 1290–1390 $cm^{-1}$ range. FIG. 11B is a Raman spectra of the HPHT treated sample in the 1520–1620 $cm^{-1}$ range. FIG. 12A is a secondary electron image scanning electron micrograph of the HPHT treated sample. FIG. 12B is a backscattered electron image scanning electron micrograph of the HPHT treated sample.

EXAMPLE 3

Nanophase WC/15 wt. % Co powder was uniaxially compacted at 50 MPa into a 3 mm diameter×2 mm high sample, and partially sintered by heating in flowing $H_2$ at 1000° C. The resulting porous preform was infiltrated with graphitic carbon, using a flowing gas mixture of $H_2$/20% $CH_4$ mixture at 950° C. for 1 hour. The procedure was similar to example 1, except for the much faster kinetics of carbon deposition, due to the higher concentration of $CH_4$ in the gas stream, and the higher reaction temperature. The effect of this treatment was to develop a compositionally graded structure, in which the carbon concentration gradually decreases from the surface to the interior of the sample. After infiltration, the sample was heated to ~1600° C. under a pressure of 8 GPa in order to fully consolidate the material, and to transform the graphite to diamond. The resulting WC/Co/diamond nanocomposite material, in which the diamond concentration gradually diminishes from the surface to the interior, is described as a functionally graded material, because it combines a wear resistant diamond-enriched surface with a strong, tough supporting core of WC/Co.

EXAMPLE 4

Nanophase WC/15 wt. % Co powder was mechanically milled using a Union Process H-01 attritor mill. The mill was operated at 250 rpm and the milling time was 3 hours. The charge was 100 gm of WC/Co powder and 2000 gm of 0.6 cm diameter grinding balls. The milling medium consisted of eskar wax dissolved in 150 cc of hexane. After milling, about 80 gm of powder was recovered.

The milled powder was uniaxially compacted at 50 MPa into a 3 mm diameter×2 mm high sample, dewaxed at 500° C., and pre-sintered at 900° C. in vacuum. The resulting porous preform was infiltrated with carbon, as in example 1. The rate of carbon pickup was slow; only about 25 vol. % carbon was infiltrated in 3 hours, using a $H_2$/10% $CH_4$ mixture at 900° C. The infiltrated sample was HPHT pressed to consolidate and transform the carbon to diamond.

EXAMPLE 5

Mechanically milled powder, as in Example 4, was dispersed in an aqueous solution of polyvinyl alcohol (PVA), and spray dried in a Yamato spray drier to form spherical agglomerates. The spray drying solution contained 50 wt. % of WC/Co solid, 5 wt.% of PVA binder, and 45 wt. % of water. The spray drying conditions were as follows: inlet temperature 290° C., outlet temperature 70–80° C., atomizing air pressure 2 $kg/cm^2$, nozzle diameter 0.15 cm, and drying air flow rate 0.6 $cm^3$/min. The agglomerated powder had a mean particle size of 60 micron.

The agglomerated powder was uniaxially compacted at 50 MPa into a 3 mm diameter×2 mm high sample, dewaxed at 250° C., and pre-sintered at 900° C. in vacuum. The resulting porous preform was infiltrated with carbon, as in example 1. The rate of carbon pickup was slow; only about 25 vol. % carbon was infiltrated in 3 hours using a $H_2$/10% $CH_4$ mixture at 900° C. The infiltrated sample was HPHT pressed to consolidate and transform the carbon to diamond.

EXAMPLE 6

Nanophase WC/15 wt. % Co powder (50 micron shell diameter, 5 micron wall thickness, 0.05 micron grain size) was compacted on a supporting fully dense WC/15 wt. % Co substrate. The compact was placed in an inert gas furnace and heated to 1050° C. for 30 minutes. A porous WC/Co sponge formed on the dense WC/Co substrate. The apparent density of the sponge was ~7.0 $g/cm^3$, and open porosity was 50%. The apparent density of the substrate was ~14 $g/cm^3$, and open porosity was 0%. The sample was cylindrically shaped to 4.5 mm diameter and 3 mm height. Chemical vapor infiltration of the porous part of the compact was carried out in a controlled atmosphere thermal gravimetric analyzer, as in Example 1. The sample with the carbon deposited in its pores was placed in a HPHT reaction cell and heated to 1500° C. under a pressure of 9 GPa for 10 sec. In the presence of Co, the graphite-like carbon transformed into diamond polycrystal with a crystallite size of 0.1–1.0 micron. The sponge-like diamond grew through the sponge-like WC/Co.

EXAMPLE 7

The sample was prepared as in Example 6. Liquid phase infiltration of the porous part of the compact was carried out in the HPHT reaction cell at a pressure of 0.5 GPa and a temperature of 300° C. At this temperature, the pitch melted and infiltrated into the porous compact. The temperature was then increased to 600° C. at the same pressure in order to carbonize the hydrocarbon. The sample was placed in a vacuum furnace for heat treatment to 1400° C. to graphitize the carbon. The sample with the carbon deposited in its pores was placed in a HPHT reaction cell and heated to 1000° C. under a pressure of 15 GPa for 10 sec. The graphitic carbon transformed into diamond polycrystal, as in Example 6, but with a crystallite size of 0.005–0.1 micron.

EXAMPLE 8

The sample was prepared as in Example 6. Impregnation of $C_{60}$ fullerene into the porous part of the compact was carried out in the HPHT reaction cell at a pressure of 1 GPa and a temperature of 300° C. At this temperature the fullerene $C_{60}$ impregnated the pores. The pressure was then increased to 8 GPa, and the temperature was increased to 1200° C. The fullerene carbon transformed into diamond polycrystal, as in Example 6, but with a crystallite size of 0.005–0.05 micron.

EXAMPLE 9

SiC powder was mixed with 15 wt. % Ni—Fe—Co—Cr eutectic alloy and milled, as in Example 4. The milled powder was compacted and sintered in an inert gas furnace at a temperature of 1300° C. and at ambient pressure. The fully dense substrate of polycrystalline SiC/NiFeCoCr was placed in a graphite crucible. The same powder was poured onto the substrate and sintered in an inert gas furnace at a temperature of 900° C. for 30 min. SiC/NiFeCoCr sponge appeared on the SiC/NiFeCoCr substrate with zero porosity. The open porosity of the sponge was 50%. Chemical vapor infiltration of the porous part of the compact was carried out as in Example 1.

The sample with carbon deposited in its pores was placed in the HPHT reaction cell and heated to 1200° C. under a pressure of 7 GPa for 30 sec. In the presence of Ni—Fe—Co—Cr alloy, the graphite-like carbon transformed into diamond polycrystal with a crystallite size of 1–2 micron.

From the foregoing examples, it is apparent that both uniform and functionally graded WC/Co/diamond nanocomposites can be produced using the method of this invention. Of course, it should be understood that a wide range of changes and modifications in the preferred embodiment described above will be apparent to those skilled in the art. It is, therefore, intended that the foregoing detailed descriptions be regarded as illustrative rather than limiting, and that it be further understood that it is in the following claims, including all equivalents, that we intend to define the scope of the present invention.

What is claimed is:

1. A tricontinuous composite comprising:

a superhard phase material;

a hard phase material; and a binder phase material;

wherein the three material phases are three-dimensionally interconnected, the superhard phase material forms approximately 10–80 volume percent of an exterior surface of the composite, and each of the three material phases has a grain size which is less than 0.1 microns.

2. The composite according to claim 1, wherein the hard phase material comprises a material selected from the group consisting of WC, SiC, $B_4C$, $Cr_3C_2$, VC, TaC, NbC, HfC and mixtures thereof, the binder phase material comprises a material selected from the group consisting of Co, Ni, Cr, Fe, Mn, and mixtures thereof.

3. The composite according to claim 2, wherein the superhard phase material comprises a material selected from the group consisting of diamond, cubic BN, boron carbonitride, mixtures of diamond and cubic BN, and mixtures of diamond and boron carbonitride.

4. The composite according to claim 1, wherein the superhard phase material comprises a material selected from the group consisting of diamond, cubic BN, boron carbonitride, mixtures of diamond and cubic BN, and mixtures of diamond and boron carbonitride.

5. The composite according to claim 1, wherein the hard phase material comprises WC and the binder phase material comprises Co.

6. The composite according to claim 5, wherein the superhard phase material comprises diamond, the diamond and WC phases forming approximately 50–97 volume percent of the composite and the Co phase forming a balance of the composite.

7. The composite according to claim 6, wherein each of the three material phases has a grain size which approximately ranges between 0.005 microns and 0.1 microns.

8. The composite according to claim 1, wherein each of the material phases has a grain size which approximately ranges between 0.005 microns and 0.1 microns.

9. The composite according to claim 1, wherein the superhard phase material is uniformly distributed throughout the composite.

10. The composite according to claim 1, wherein the volume percentage of the superhard phase material changes gradually through the composite.

11. The composite according to claim 1, wherein the composite defines one of a machine tool, a drill bit, and a wear part.

* * * * *

UNITED STATES PATENT AND TRADEMARK OFFICE

CERTIFICATE OF CORRECTION

PATENT NO. : 6,214,079 B1
DATED : April 10, 2001
INVENTOR(S) : Kear et al.

It is certified that error appears in the above-identified patent and that said Letters Patent is hereby corrected as shown below:

Column 3,
Line 62, presently reads: "diamond, cubic boron nitride BN), boron carbonitride, mix-". Please correct to read: -- diamond, cubic boron nitride (BN), boron carbonitride, mix- --.

Column 8,
Line 40, presently reads: "and from 1520-1620 $cm^{-1}$ at 0.1 $cm^{-1}$ intervals. FIG. 9A is". Please correct to read: -- and from 1520-1620 $cm^{-1}$ at 0.1 $cm^{-1}$ intervals. FIG. 9A is --.
Line 43, presently reads: "$cm^{31\ 1}$. The first peak corresponds to diamond and the". Please correct to read: -- $cm^{-1}$. The first peak corresponds to diamond and the --.

Signed and Sealed this

Eighth Day of January, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,214,079 B1
DATED : April 10, 2001
INVENTOR(S) : Kear et al.

It is certified that error appears in the above-identified patent and that said Letters Patent is hereby corrected as shown below:

Column 1,
Directly following the first paragraph, please insert

-- STATEMENT REGARDING FEDERALLY SPONSORED RESEARCH OR DEVELOPMENT

This invention was prepared under a government subcontract with the Department of Energy, subcontract number DE-FC04-95AL880021. --

Signed and Sealed this

Eighteenth Day of November, 2003

JAMES E. ROGAN
*Director of the United States Patent and Trademark Office*